United States Patent [19]

Yang

[11] Patent Number: 4,640,419

[45] Date of Patent: Feb. 3, 1987

[54] PACKING STRUCTURE FOR A HANGING FAN

[76] Inventor: Tai-Her Yang, 5-1 Taipin St., Si-Hu Town, Dzan-Hwa, Taiwan

[21] Appl. No.: 793,111

[22] Filed: Oct. 30, 1985

[51] Int. Cl. ..... B65D 69/00

[52] U.S. Cl. ..... 206/577; 206/320; 206/499

[58] Field of Search ..... 206/320, 499, 564, 576, 206/577

[56] References Cited

U.S. PATENT DOCUMENTS 4,166,531 9/1979 Fujiwara ..... 206/320

FOREIGN PATENT DOCUMENTS 52786 4/1977 Japan ..... 206/576

*Primary Examiner*—John Sipos

*Attorney, Agent, or Firm*—Leonard Bloom

[57] ABSTRACT

A packing structure for a disassemblable hanging fan assembly is presented. This structure is comprised of an upper storage tray, a lower storage tray adapted to receive the upper storage tray thereon in a stacked fashion, and a carton for receiving and enclosing the stacked upper and lower trays. The upper storage tray is substantially rectangular in shape, its diagonal length being determined by the length of the longitudinal axis of the fan blade. Both the upper and the lower storage trays are provided with a plurality of slots formed therein to receive the various disassembled parts of the hanging fan.

7 Claims, 2 Drawing Figures

PACKING STRUCTURE FOR A HANGING FAN

BACKGROUND OF THE INVENTION

The common method for transporting hanging fans is to pack the fan after dismounting of the blade and the hang supporter therefrom. The storage space of this common packing method is wasted. The purpose of this invention is to reduce packing and transport volume using a special packing structure during the shipment in order to reduce the shipping cost.

DESCRIPTION OF THE PREFERRED EMBODIMENT

Figure 1:
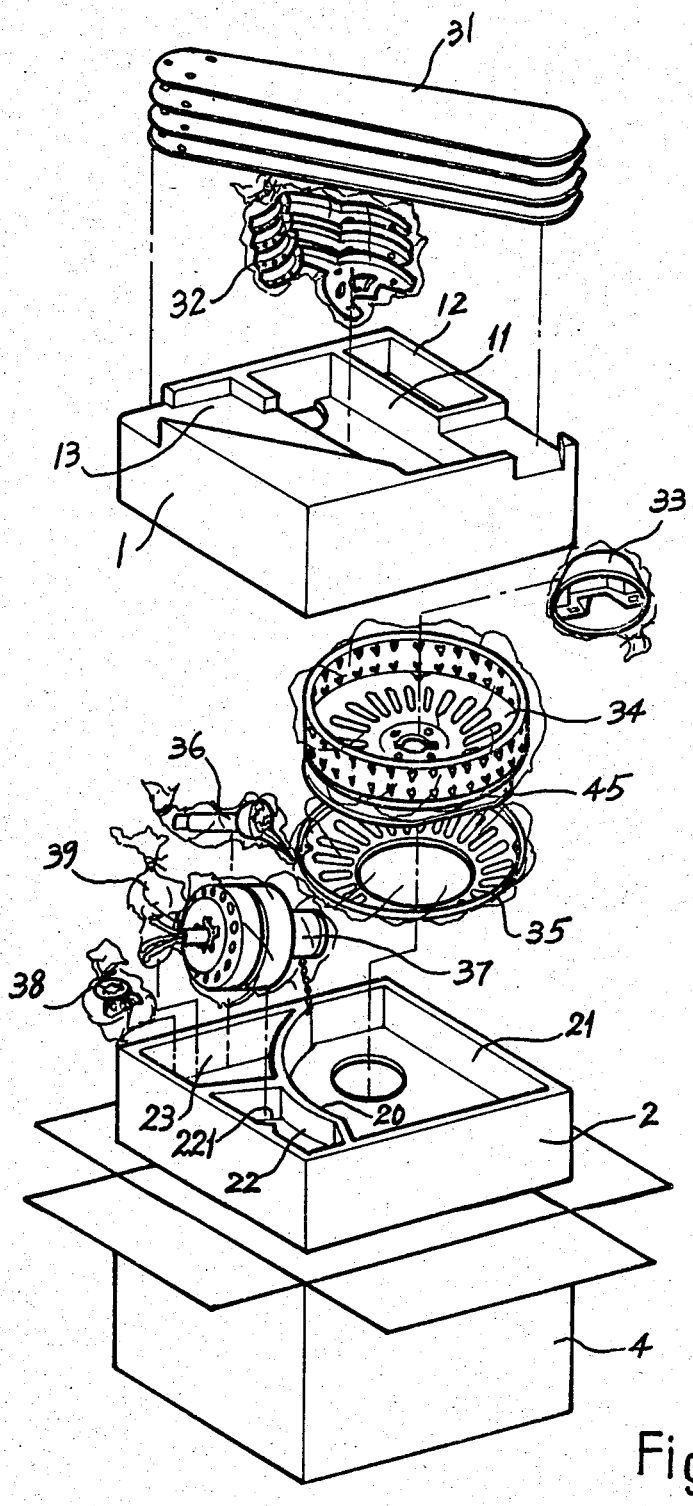
FIG. 1 is an exploded perspective view of the upper and lower cases (trays) and the carton of the present invention.

Referring now to the drawings, there is illustrated the preferred embodiment of the packing structure for a hanging fan assembly of the present invention comprising two rectangular cases (storage trays) which can be stacked one over the other. As illustrated, these storage trays are an upper case (upper storage tray) 1 and a lower case (lower storage tray) 2. The hanging fan assembly which is stored in this structure comprises blade 31, connector 32, upper cover 33, upper housing 34, lower housing 35, hand supporter 36, motor and switch 37, cushion piece 38 and fixed piece 39, as shown in FIG. 1.

Figure 2:
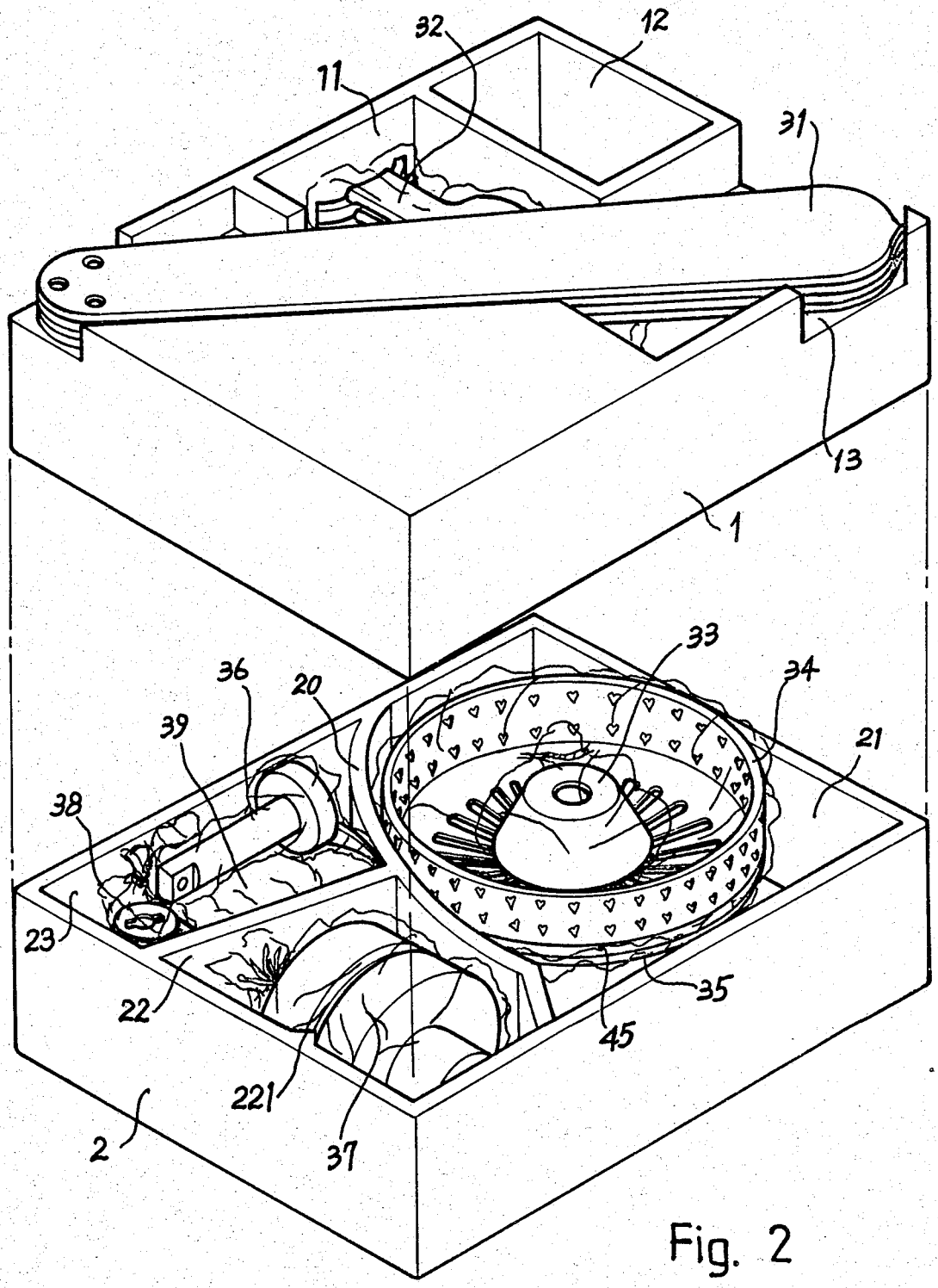
FIG. 2 is another exploded perspective view of the packing structure of the present invention showing parts of the hanging fan filled into the upper and lower cases (trays).

In conventional hanging fans, the blade is the part having the largest length. Accordingly, the diagonal length of the upper case 1 and the lower case 2 are dictated by the size of the blade 31. The upper case 1 of the invention is formed with a downwardly extending concave framed chute (slot) 13 therein, said slot 13 being formed diagonally therein to suit the form of blade 31 and to receive the blade therein. A suitable triangular wall (upward extension) is located at the one corner of the upper storage tray for supporting the blade therein. Another two diagonals (slots) are formed in this upper case (upper storage tray) being used for the storage room (storage slots) 11 and 12. These slots are formed having a greater depth than that of the concave framed chute (slot) 13. As illustrated, the storage room (slot) 11 is longer than slot 12. Slot 11 penetrates the framed chute (slot) 13. A semi-circular opening is formed on a room bottom (base) of slot 11 in a position opposite that end of slot 11 that penetrates the framed chute (slot) 13. This storage room (slot) 11 is used for the placing of the connector piece 32 therein, whereby the connector piece 32, being connected with the corner piece of the rotation disc, may be placed in the semi-circular opening after the stacking, as shown in FIG. 2.

The lower case 2 is divided into three parts by the separated plates (upwardly extending partitions) 20. As shown in FIG. 1, these partitions form a larger ring-shaped side room (slot) 21 having a circular opening formed therein for the storage of the upper housing 34, lower housing 35 and the upper cover 33 when said parts are nested within each other being separated by the cardboards 45 being placed between them. Another framed room (slot) 22 is provided being formed with a vertical convex conical rod (rib) 221 for being received within a slot carried by the fixing motor and switch 37, when it is inserted in the said slot 22, as shown in FIG. 2. Another storage room (slot) 23 is formed to receive therein the hanging supporter 36, cushion piece 38 and the fixed piece 39.

Excepting the blade 31, the above said hang fan assemblies are packed and sealed by the polybags before they are placed into the storage rooms.

It should be noted that, as illustrated, the upper and the lower storage tray 1 and 2 are each comprised of a substantially rectangular base having four edges. Each tray 1 and 2 is further comprised of four side walls, each side wall being secured to and extending upwardly from a respective edge of the base.

The hanging fan assemblies in the lower case (tray) 2 of the present invention are slightly upwardly convex after the placement of the relative assemblies in the lower tray 2. But in a preferred embodiment, the storage rooms 11 and 12 in the case 1 are not same depth with the bottom side of the case, so that the bottom side of the case 1 is slightly upward concave and is just suitable for the slightly upward convex situation of the hanging fan assemblies in the lower case 2. Therefore, a complete rectangular body is formed after the stacking of the upper case 1 and the lower case 2. This permits it to be positioned, stacked together in the carton 4.

What is claimed is:

1. A packaging structure for a hanging fan of the type having a housing, a motor being disassemblable from the housing, and at least one fan blade, said structure comprising:

an upper storage tray having a substantially rectangular base, said base having a diagonal slot formed therein to receive the fan blade and further having four edges, said tray further having four side walls, each side wall being secured to and extending downwardly from a respective edge of the base;

a lower storage tray adapted to receive the upper storage tray thereon, said lower tray having a substantially rectangular base having four edges, said lower tray further having four side walls, each side wall being secured to and extending upwardly from a respective edge of the base, each of said side walls being of a height to receive the housing and the motor therein; and a carton for receiving and enclosing the said upper tray and lower tray therein, and wherein the hanging fan is packaged.

2. The packaging structure of claim 1, wherein the upper storage tray is further provided with a first longitudinal slot formed therein at a greater depth than that of the diagonal slot.

3. The packaging structure of claim 2, wherein the first longitudinal slot intersects the diagonal slot.

4. The packaging structure of claim 2, wherein the upper storage tray is further provided with a second longitudinal slot being positioned parallel to the first longitudinal slot.

5. The packaging structure of claim 1, wherein the motor of the hanging fan is received in the lower tray with the axis of rotation of said motor being positioned parallel to the plane of the base.

6. The packaging structure of claim 1, wherein the lower storage tray is provided with a curved upwardly extending first partition, said first partition being integrally formed with the base and being further integrally formed with two opposite end walls, whereby a first slot is formed to receive the housing therein and further, whereby a second slot is formed to receive the motor therein.

7. The packaging structure of claim 6, wherein the lower storage tray is further provided with an upwardly extending second partition, said second partition being integrally formed with the base, the arc of the first partition and a third wall.

* * * * *